US005712019A

United States Patent [19]

Driessen

[11] Patent Number: 5,712,019

[45] Date of Patent: Jan. 27, 1998

[54] BLIND COMPRISING A WOVEN OR KNITTED STRIP OF MATERIAL

[76] Inventor: Edgar Driessen, Bruchwiesenweg 8, Schlitz, Germany, D-36110

[21] Appl. No.: 532,770

[22] PCT Filed: Feb. 25, 1994

[86] PCT No.: PCT/DE94/00204

§ 371 Date: Sep. 28, 1995

§ 102(e) Date: Sep. 28, 1995

[87] PCT Pub. No.: WO94/23170

PCT Pub. Date: Oct. 13, 1994

[30] Foreign Application Priority Data

Apr. 1, 1993 [DE] Germany ..... 9304940 U
Jun. 17, 1993 [DE] Germany ..... 43 20 007.9

[51] Int. Cl.[6] ..... B32B 3/28; A47H 1/00

[52] U.S. Cl. ..... 428/178; 428/188; 428/196; 428/224; 160/166.1; 160/330

[58] Field of Search ..... 428/178, 174, 428/181, 188, 196, 197, 224; 160/166.1, 330, 84.03, 349.1, 900, 901, DIG. 7

[56] References Cited

U.S. PATENT DOCUMENTS

| | | | |
|---|---|---|---|
| 1,937,342 | 11/1933 | Hybie | 88/60 |
| 4,542,055 | 9/1985 | Fitzsimmons | 428/102 |
| 5,346,774 | 9/1994 | Burgess | 428/107 |

*Primary Examiner*—Donald Loney
*Attorney, Agent, or Firm*—Thomas R. Vigil

[57] ABSTRACT

Disclosed is a woven or knitted strip of material for use in a blind having a plurality of pockets (2) being separated by each other by bridges (2*a*). These pockets (2) are designed to be fitted with suspension devices (3) or tensioning weights (4), whereas the pockets are woven or knitted parallely to each other into the strip of material.

3 Claims, 1 Drawing Sheet

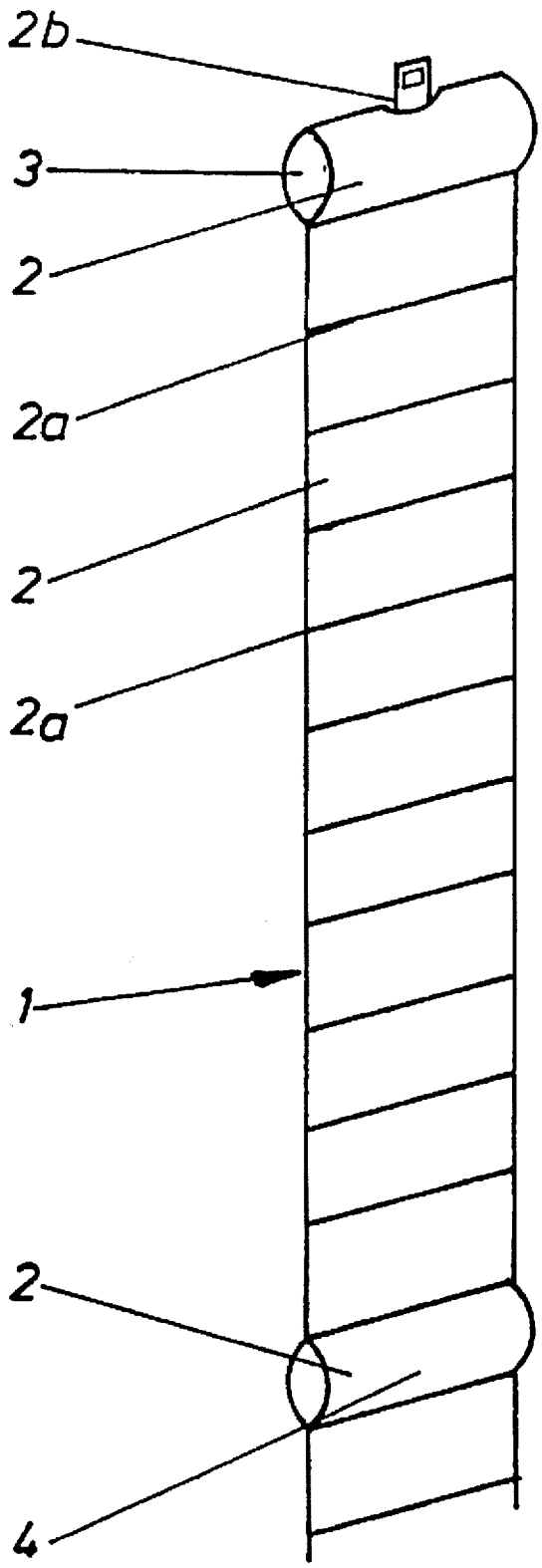
2b
3
2
2a
2
2a
1
2
4

BLIND COMPRISING A WOVEN OR KNITTED STRIP OF MATERIAL

BACKROUND OF THE INVENTION

1. Field of the Invention

The present invention relates to a strip of woven or knitted material for use in a blind.

2. Description of the Related Art Including Information Disclosed Under 37 CFR §§ 1.97–1.99.

Blinds are well-known; they are used to provide shade on window panes. A blind provides suspension devices at one end and a tensioning weight at its other end in order to guarantee a stable vertical position of the blind.

According to the state of the art (DE 37 07 030) the pocket designed to be fitted with suspension devices or tensioning weights, respectively, are either welded, glued or sewn. That to say that once the strip of woven or knitted material has been manufactured, the pockets have to be inserted separately by either sewing, gluing or welding them onto the material.

This disadvantage thereof is that due to these additional operations necessary to insert the pockets into the blind, the production of blinds is relatively expensive.

SUMMARY OF THE INVENTION

The object of the present invention is therefore to provide a strip of woven or knitted material for use in a blind, which can be produced easily and thus at low costs.

According to the present invention, this object is solved by pockets designed to be fitted with suspension devices or tensioning weights, which are woven or worked parallely to each other into the strip of material. In the area of the pockets, the strip of material is double layered for forming pockets. In order to simplify the weaving or knitting process, the pockets are positioned parallel to the direction of the inlaid yarn in the strip of material. When several pockets are woven or knitted parallely to each other into the strip of material, the strip of material used for the production of a blind of any length can be cut through at the bridges boardering the pockets. That means that by providing a strip of material with several pockets positioned parallely and on top of each other, blinds of any length and width can be easily produced without having to proceed to second operation as it is the case in the state of the art.

Relating to the drawing, the invention is described more thoroughly hereinafter.

DESCRIPTION OF THE PREFERRED EMBODIMENT(S)

The drawing shows a blind 1 with several pockets 2 positioned on top of each other, whereby the upper pocket is designed to be fitted with a suspension device 3 and the lower pocket with a tensioning weight 4. The bridges between the pockets got the numeration **2*a*. It is evident that in order to produce a blind of any length, the corresponding blind just has to be cut off at the bridge 2*a*. Then, a suspension device 3 can be inserted into the following pocket, after having cut a hole 2*b*** into that pocket. The blinds cannot only be produced in any length but also in any width, whereby the strip of material has to be cut widthwise.

I claim:

1. Blind comprising a woven or knitted strip of material, characterized by a plurality of pockets (2) which are separated from each other by bridges (**2*a*), which are designed to be fitted with suspension devices (3) or tensioning weights (4**), and which are woven or knitted parallel to each other with inlaid yarn into the blind which is in the form of a woven or knitted strip of material.

2. Blind comprising a woven or knitted strip of material according to claim 1, characterized in that the pockets (2) are positioned parallely to the direction of the inlaid yarn.

3. Blind comprising a woven or knitted strip of material according to claim 1, characterized in that the blind has two layers of material at the places, where the pockets (2) are designed to be.

* * * * *